US007008308B2

(12) United States Patent
Bjelopavlic et al.

(10) Patent No.: US 7,008,308 B2
(45) Date of Patent: Mar. 7, 2006

(54) WAFER CARRIER

(75) Inventors: Mick Bjelopavlic, O'Fallon, MO (US); Alexis Grabbe, Harvester, MO (US); Michele Haler, St. Paul, MO (US); Tracy M. Ragan, Warrenton, MO (US)

(73) Assignee: MEMC Electronic Materials, Inc., St. Peters, MO (US)

( * ) Notice: Subject to any disclaimer, the term of this patent is extended or adjusted under 35 U.S.C. 154(b) by 206 days.

(21) Appl. No.: 10/442,900

(22) Filed: May 20, 2003

(65) Prior Publication Data

US 2004/0235402 A1 Nov. 25, 2004

(51) Int. Cl.
*B24B 29/00* (2006.01)

(52) U.S. Cl. ..... 451/269; 451/398; 451/400

(58) Field of Classification Search ..... 451/41, 451/269, 385, 397, 398, 400, 402, 285, 286, 451/287, 288, 690, 692, 693
See application file for complete search history.

(56) References Cited

U.S. PATENT DOCUMENTS

| | | | | |
|---|---|---|---|---|
| 5,422,316 | A | 6/1995 | Desai et al. | |
| 5,882,245 | A * | 3/1999 | Popovich et al. | 451/41 |
| 5,914,053 | A * | 6/1999 | Masumura et al. | 216/88 |
| 6,030,280 | A * | 2/2000 | Fruitman | 451/291 |
| 6,042,688 | A * | 3/2000 | Masumura et al. | 156/345.14 |
| 6,454,635 | B1 | 9/2002 | Zhang et al. | |
| 6,458,688 | B1 | 10/2002 | Wenski et al. | |
| 6,514,424 | B1 | 2/2003 | Wenski et al. | |
| 2001/0047978 | A1 | 12/2001 | Wenski et al. | |
| 2002/0052064 | A1 | 5/2002 | Grabbe et al. | |

FOREIGN PATENT DOCUMENTS

JP 2000-173956 6/2000

OTHER PUBLICATIONS

Mendel, E., et al., Technical Report, Multiple Wafer Free Polishing—Part 1, Machine Concept, IBM Data Systems Division, Apr. 10, 1980, pp. 1-12, Reference No. TR22.2342.

* cited by examiner

*Primary Examiner*—Dung Van Nguyen
(74) *Attorney, Agent, or Firm*—Senniger Powers

(57) ABSTRACT

A wafer carrier for retaining at least one semiconductor wafer in a processing apparatus during a processing operation which removes wafer material by at least one of abrading and chemical reaction. The processing apparatus is adapted for removing wafer material from a front side and a back side of each wafer simultaneously. The carrier includes a plate including wafer contaminating material and having an opening and a thickness. An insert has a thickness and is disposed in the opening for receiving at least one wafer and engaging a peripheral edge of the wafer to hold the wafer as the carrier rotates. The thickness of the insert is significantly greater than the thickness of the plate to inhibit removal of material from the plate and thereby inhibit bulk metal contamination of the wafer.

25 Claims, 6 Drawing Sheets

WAFER CARRIER

BACKGROUND OF THE INVENTION

The present invention relates generally to semiconductor wafer processing, and more particularly to wafer carriers for retaining semiconductor wafers during processing operations.

In conventional wafer processes for removing wafer material, such as a double-side polishing operation, a wafer carrier is used to retain a plurality of wafers during the polishing operation. The wafer carrier is typically a thin, flat plate disposed between polishing pads of the polishing machine. The plate has teeth on its outer edge for engaging outer and inner pin ring drives adapted to rotate the plate during polishing. The wafer carrier is typically made of metal in order to withstand the mechanical stresses caused by the ring drives. However, during the latter stages of polishing, the pads polish not only the wafers, but also the carrier, and thereby release metal ions from the carrier. Such metal ions then enter the slurry and polishing pads and can cause bulk metal contamination of the wafers. Metals of particular concern are copper and nickel.

Plastic or fiber-reinforced plastic carriers are superior to metal carriers in terms of bulk metal contamination of the wafers, but the reduced strength of such carriers makes them unreliable. Plastic-coated metal carriers are generally unreliable because the plastic tends to delaminate, thus exposing the metal and scratching the wafers. It has been suggested to reduce bulk metal contamination by attempting to ensure that polishing of the wafer is stopped before the wafer thickness is the same as that of any metal portion of the carrier. However, such polishing requires the use of lower pad pressure against the wafers (which reduces polishing efficiency) to avoid rounding at the edges of the wafer. Therefore, such polishing is not ideal for efficient throughput or for producing the flattest wafers possible.

SUMMARY OF THE INVENTION

Among the several objects of the present invention may be noted the provision of a wafer carrier for retaining a plurality of semiconductor wafers in a processing apparatus which reduces bulk metal contamination of the wafers; the provision of such a wafer carrier which promotes flatness in the wafers; and the provision of such a wafer carrier which promotes efficient processing of the wafers.

In general, the present invention is directed to a wafer carrier for retaining at least one semiconductor wafer in a processing apparatus during a processing operation which removes wafer material by at least one of abrading and chemical reaction. The processing apparatus is adapted for removing wafer material from a front side and a back side of each wafer simultaneously. The carrier comprises a plate including wafer contaminating material and has an opening and a thickness. An insert of the carrier has a thickness and is disposed in the opening of the plate for receiving at least one wafer and engaging a peripheral edge of the wafer to hold the wafer as the carrier rotates. The thickness of the insert is at least about 20 microns greater than the thickness of the plate to inhibit removal of the contaminating material from the plate during processing and thereby inhibit contamination of the wafer.

In another aspect of the invention, the wafer carrier comprises a plate including wafer contaminating material and having an opening. An insert is removably disposed in the opening of the plate and has holes for receiving at least two wafers and engaging a peripheral edge of each wafer to hold each wafer as the carrier rotates. The insert has negative buoyancy in a polishing fluid to inhibit the insert from separating from the plate during loading and unloading of wafers.

In yet another aspect, the invention is directed to a double-side polishing apparatus for polishing front and back sides of semiconductor wafers simultaneously. The apparatus comprises a rotatable upper platen mounting an upper polishing pad and a rotatable lower platen mounting a lower polishing pad. A wafer carrier for retaining a set of the semiconductor wafers in between the upper and lower pads includes a plate made at least partially of metal and having an opening. An insert of the carrier has a thickness and is disposed in the opening for receiving the set of wafers. The thickness of the insert is at least 20 microns greater than the thickness of the plate to inhibit removal of material from the plate and thereby inhibit bulk metal contamination of the wafer.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
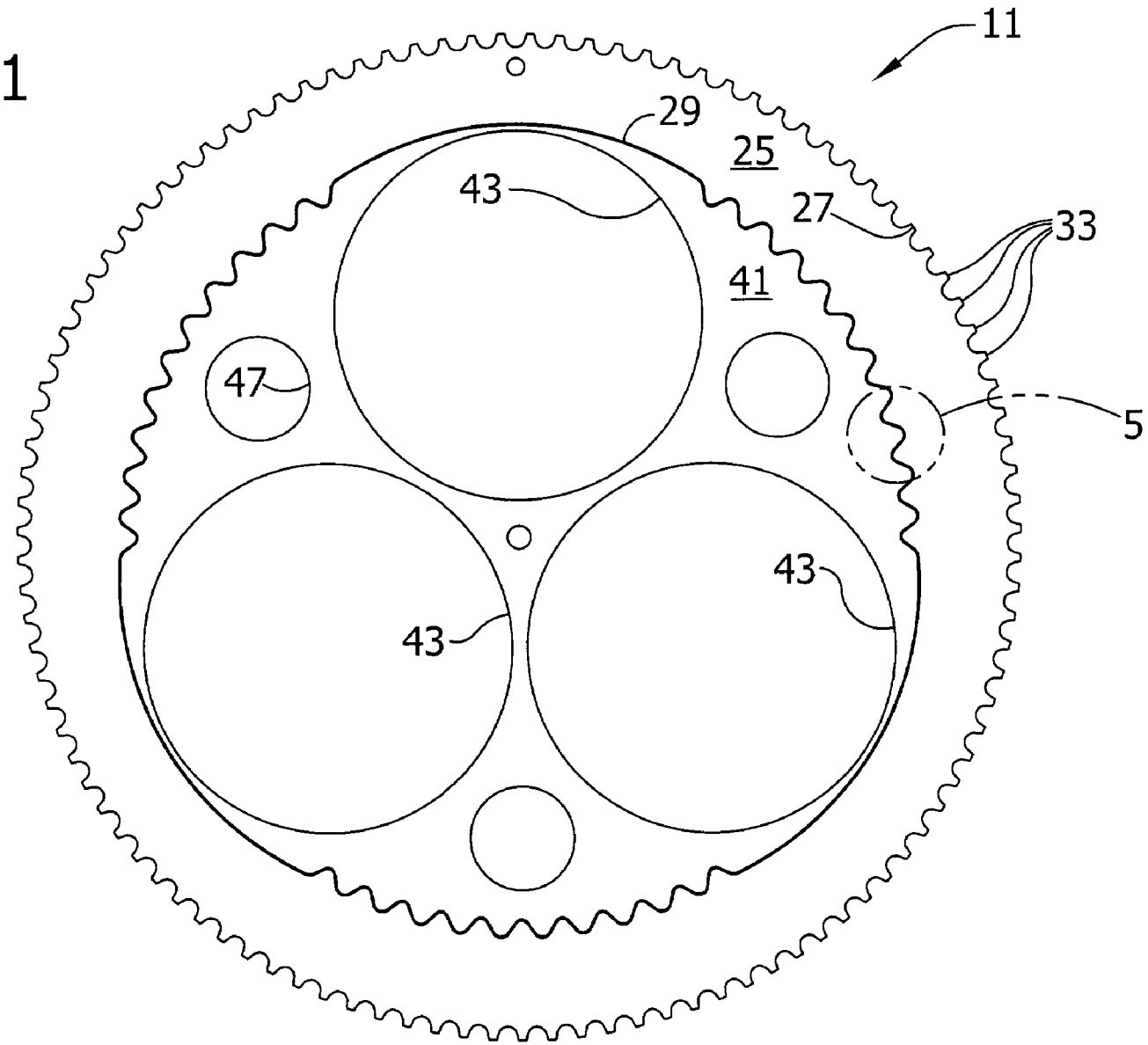
FIG. 1 is a plan view of an embodiment of a wafer carrier of the present invention.
Figure 2:
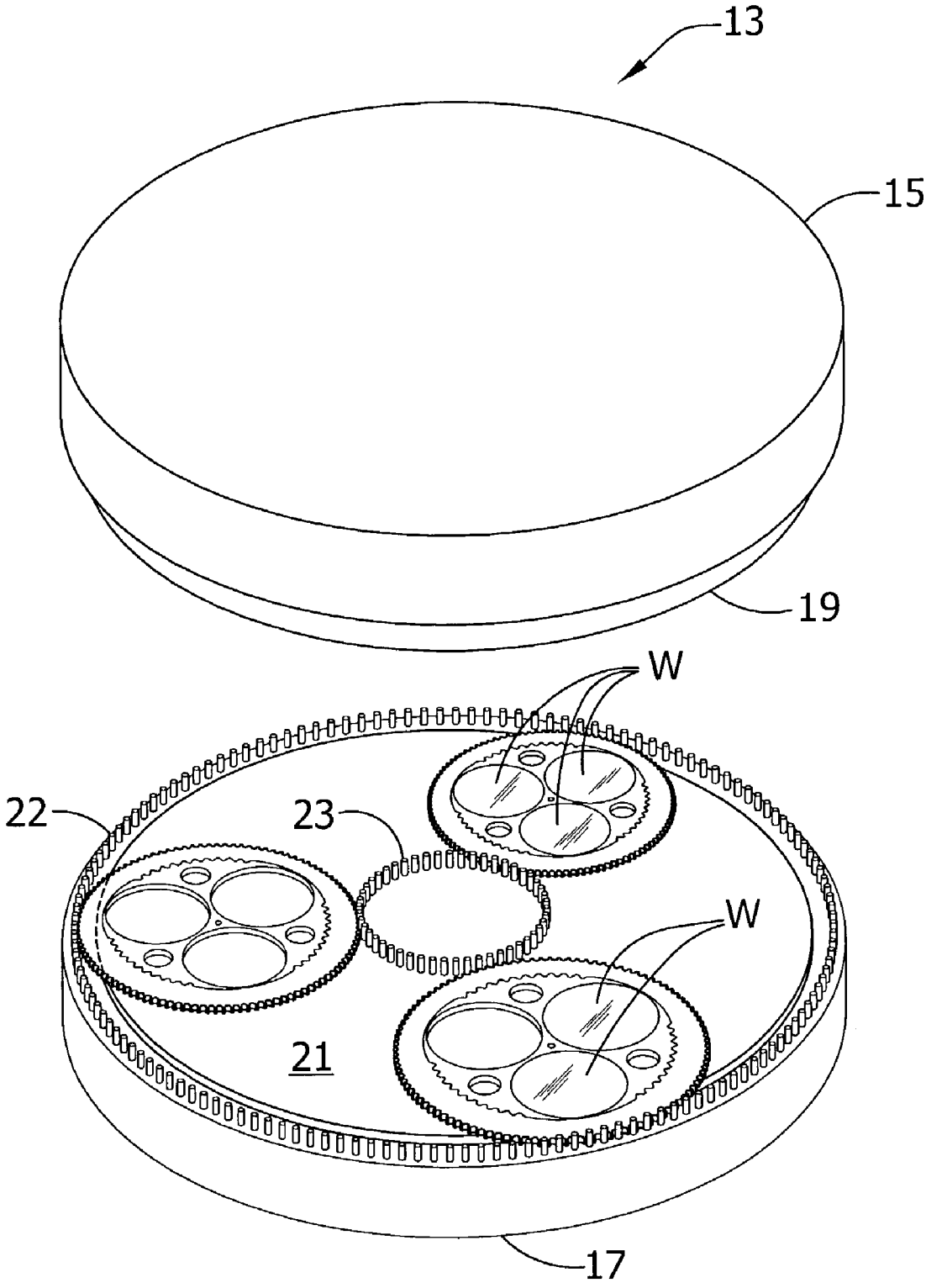
FIG. 2 is a schematic perspective view of a portion of the processing apparatus including three wafer carriers, an upper platen of the apparatus being raised to reveal all three wafer carriers.

Referring now to the drawings and in particular to FIGS. 1 and 2, an embodiment of a wafer carrier of the present invention is designated in its entirety by the reference numeral 11. Generally, the carrier retains three semiconductor wafers W in a conventional double-side processing apparatus, referred to generally as 13, during a processing operation which removes wafer material by at least one of abrading and chemical reaction. The processing apparatus 13, a portion of which is shown schematically in FIG. 2, is adapted for removing wafer material from a front side and a back side of each wafer W simultaneously. The apparatus 13 includes a circular upper platen 15 and a circular lower platen 17. For polishing wafers, an upper polishing pad 19 is mounted on the downwardly facing surface of the upper platen 15 and a lower polishing pad 21 is mounted on the upwardly facing surface of the lower platen 17. Outer and inner pin ring drives, numbered 22 and 23 respectively, are adapted to rotate the carrier 11 during polishing. The platens 15, 17 and polishing pads 19, 21 are sized to receive multiple carriers (e.g., three as shown) therebetween.

Figure 3B:
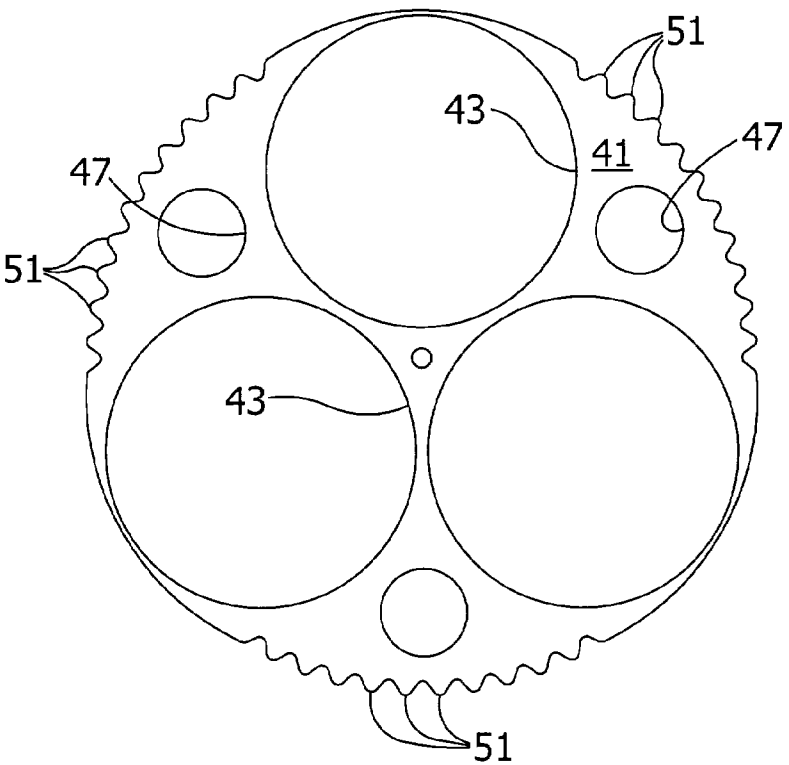
FIGS. 3A and 3B are plan views of a plate and an insert, respectively, of the wafer carrier.
Figure 3A:
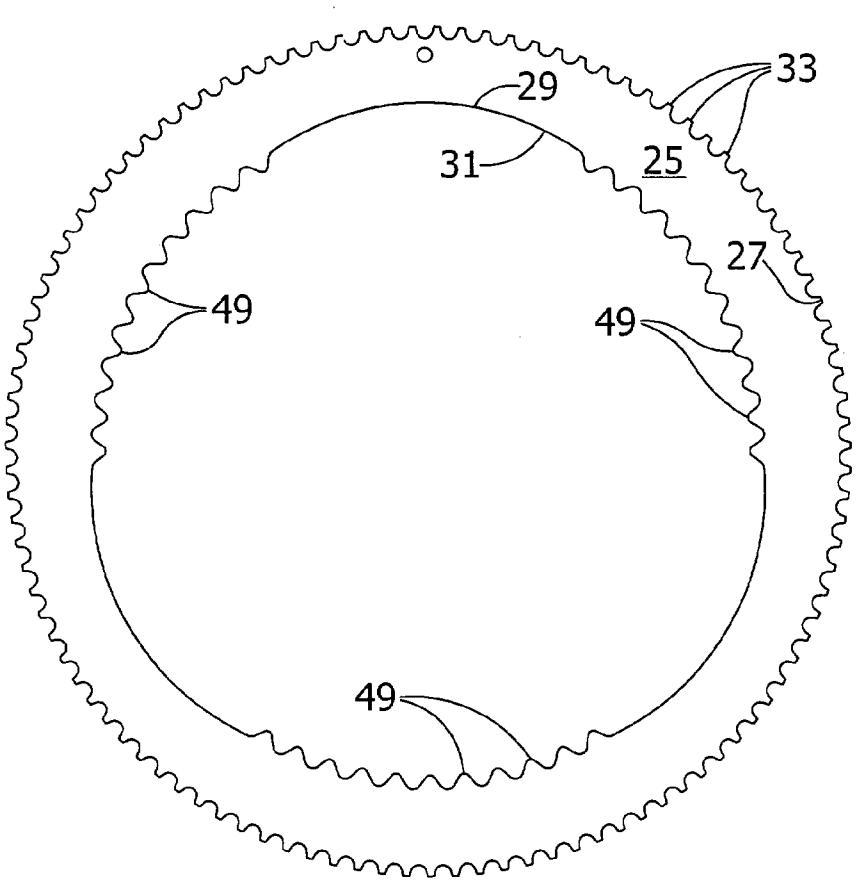

Referring to FIGS. 2 and 3A–3B, the carrier 11 comprises a generally ring-shaped gear or plate 25 having an outer periphery or edge 27 and an inner edge 29 defining an opening 31. Gear teeth 33 on the outer edge 27 of the plate 25 are sized and shaped for engaging the outer and inner pin ring drives 22, 23 of the processing apparatus 13. The plate 25 must have sufficient strength to withstand the mechanical stresses (primarily compressive and tensile) caused by the ring drives 22, 23, and is at least partially made of material which may contaminate the wafer. The plate 25 of this embodiment is made of metal to withstand the mechanical stresses, but any material (including composite materials) having sufficient strength may be used within the scope of this invention. The plate 25 is preferably made of metals low in copper and nickel including 1074, 1075, 1095 carbon steel and 420 or 440C stainless steel. Generally, preferred materials are strong enough to engage the pin drives without permanent deformation of the gear teeth 33.

The carrier 11 also comprises an insert 41 (FIG. 3B) receivable in the opening 31 of the plate 25. The insert 41 has three large circular holes 43, each hole being adapted for receiving one of the wafers W and engaging a peripheral edge WE of the wafer to hold the wafer as the carrier 21 rotates so as to inhibit damage to the wafer during rotation. The insert may also include small slurry holes 47 to allow polishing slurry to flow through the insert. The insert 41 of this embodiment is made of a polymer. Suitable polymers are chemically compatible with the polishing slurry applied to the pads during polishing, have sufficient strength to withstand the mechanical stresses of polishing and are resistant to abrasion. Suitable polymers include polyvinylidenefluoride (PVDF, e.g., Kynar™ 740), polyether ketone (PEEK), polyetherimide (e.g., Ultem™), PTFE, EFTE (e.g., Tefzel™), CTFE, FEP, polypropylene and polyimide. In some applications, it may be desirable to make the insert 41 of higher tensile strength materials, such as carbon fiber or graphite fiber reinforced PVDF and fiberglass (such as FR4™). Note however, that fiber-free and bulk particle-free materials are preferred. Each hole 43 is preferably cut (i.e., not molded) so that the edges 45 of the hole are sharp (i.e., the edges are not radiused) to inhibit the wafer W from slipping out of the hole and becoming wedged between the insert 41 and one of the polishing pads 19, 21. The insert may also be made with just one hole for holding just one wafer W. In such case, a center of the hole (and thus a center of the wafer held therein) is preferably offset from the center of the carrier so the wafer follows an epicyclic planetary path to "average out" the effects of pad non-uniformity during polishing, as further discussed in co-assigned U.S. patent application Ser. No. 09/928,559, filed Aug. 13, 2001, which is incorporated herein by reference.

Figure 4:
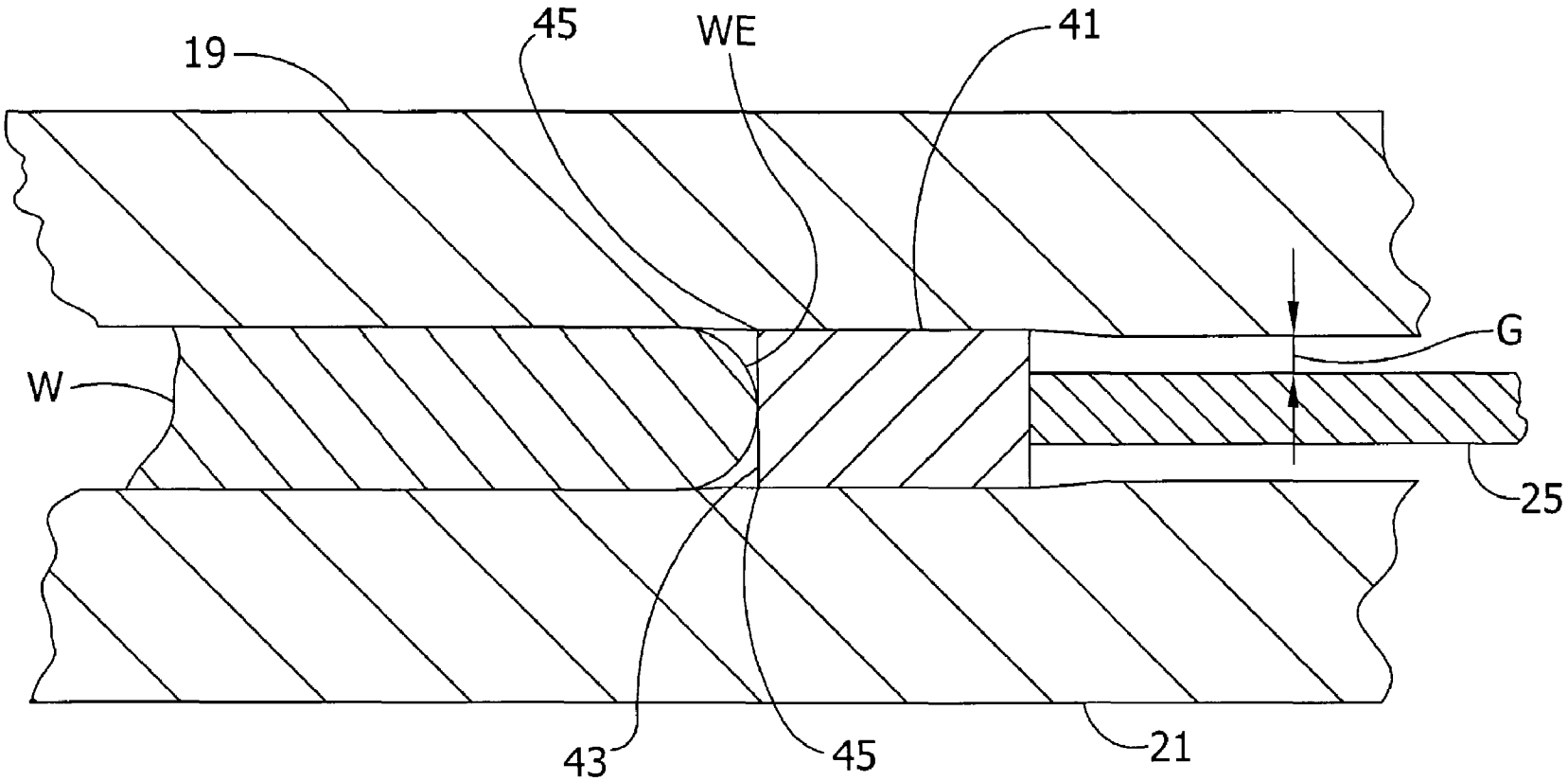
FIG. 4 is a fragmentary, schematic, enlarged section through a semiconductor wafer, one of the carriers and the polishing pads during polishing of the wafer.

As shown in FIG. 4, the insert 41 has a thickness significantly greater than a thickness of the plate 25 to inhibit removal of material from the plate (i.e., polishing of the plate) and thereby inhibit bulk metal contamination of the wafers W. To ensure that no polishing of the plate 25 occurs, the plate is thinner than the insert 41 by more than the maximum deflection of the polishing pads outside an outer edge of the insert. The plate 25 is thinner by at least about 15 microns, preferably by at least about 20 microns, more preferably by at least about 30 microns and most preferably by at least about 50 microns. Typically, the plate is about 50 to 75 microns thinner than the insert. The gap G between the plate 25 and each pad 19, 21 is at least about 20–25 microns. The actual gap G is somewhat reduced due to the deflection of the polishing pads 19, 21 and due to polishing the wafer to less than the thickness of the insert, but as noted, there is a sufficient thickness difference between the plate 25 and the insert 41 of this embodiment that there is substantially no polishing of the plate or material removal from the plate. In one example, the insert is about 725 microns thick and the plate is suitably about 590 to about 675 microns thick, more preferably about 650–670 microns thick. In contrast, the inserts of U.S. Pat. No. 6,454,635 are only about 10 microns thicker than the plate. Due to factors such as deflection of the polishing pads and wearing of the inserts (there may be other factors as well), such a small thickness difference will allow polishing of the metal plate and will therefore cause bulk metal contamination of the wafers.

The insert 41 is preferably about the same thickness as the target post-polishing thickness of the wafers W so that polishing is stopped when the thickness of the wafers is the same or slightly less than that of the insert. Indeed, it may be preferable to polish the wafers to a thickness slightly less than that of the insert 41 because it has been found that flatness is enhanced by polishing to such thickness.

Figure 5:
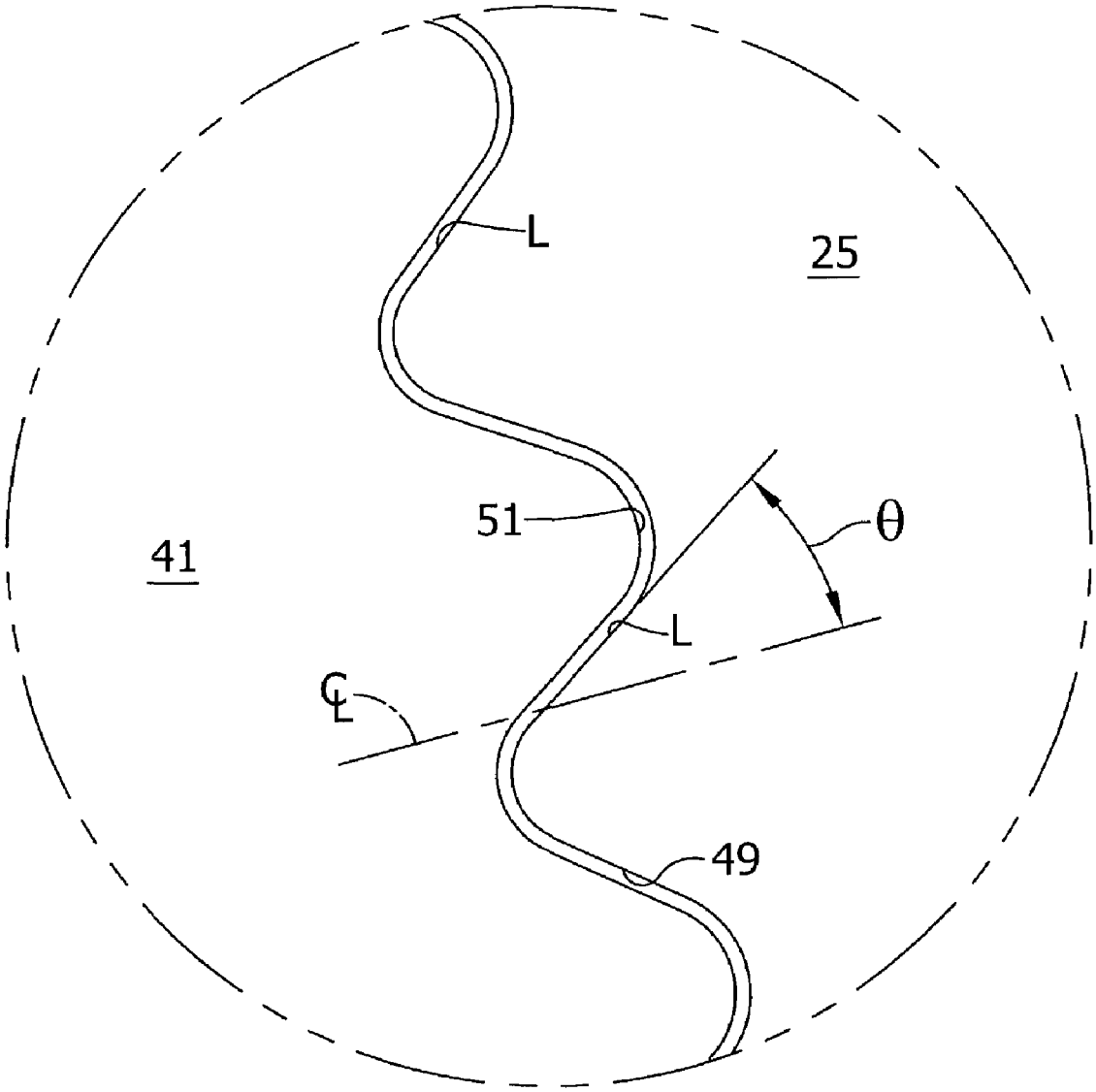
FIG. 5 is an enlarged view of a portion of FIG. 1 showing interengaged teeth of the insert and the plate of the wafer carrier.

Referring to FIGS. 1 and 5, the insert 41 of this embodiment releasably engages the plate 25 so that the insert is removable from the plate. To prevent rotation or significant uncontrolled movement of the insert 41 relative to the plate 25 during processing, the inner edge 29 of the plate includes teeth 49 for engaging teeth 51 formed on the periphery of the insert. There are three sets of teeth 49, 51, but there may be more or less teeth within the scope of the invention. Preferably, the teeth 49, 51 are formed such that contact area capable of transferring rotational force from the plate 25 to the insert 41 is maximized to better distribute stress in each tooth, while also allowing for ease of placement of the insert within the opening. As shown in FIG. 5, there is significant contact area, such as at line segments L, between the interengaged teeth 49, 51. Increasing the contact area serves to better distribute stress in each tooth so that each tooth is less likely to fail. Accordingly, the insert 41 may be made of a relatively lower strength polymer, such as PVDF. In operation, the plate 25 is laid on the lower polishing pad 21, the insert 41 is laid into the opening 31 of the plate such that the teeth 49, 51 mesh together, and the wafers W are thereafter placed in the holes 43 of the insert. The teeth are preferably formed so that the insert 41 may be easily placed within the opening 31 when the plate is resting on the lower pad 21. For example, it has been found that tooth pressure angle $\Theta$ (i.e., the angle between a center line CL extending from the center of the plate or insert) should be significantly greater than zero, e.g., at least about 10° for ease of placement of the insert 41. Further, each tooth is symmetrical, i.e., the angle of each side of each tooth relative to the center line CL is identical, so that the stress distribution through the tooth is substantially identical regardless of which direction the plate 25 is turning the insert 41.

The insert 41 of this embodiment is not buoyant in the water, polishing slurry or other liquid placed on the lower pad 21. In other words, the density and mass of the insert is such that the insert has negative buoyancy to inhibit the insert from floating on the water, slurry or other liquid and thereby becoming disengaged from the plate 25. It has been found that with smaller inserts such floating may occur, typically after the insert 41 is placed in the plate 25 but prior to the upper polishing pad 19 beginning to exert pressure on the insert during polishing.

The plate 25 is sized so that no portion of its inner edge 29 extends outside the periphery of the upper and lower pads 19, 21, i.e., all of the inner edge is positioned directly over the lower polishing pad 21 and directly under the upper polishing pad 19. (See FIGS. 2 and 4). Such positioning of the inner edge 29 within the periphery of the pads 19, 21 inhibits flexing of the plate 25 and thereby reduces the risk that the inner edge will bend and cut the pads during polishing.

During polishing, the upper platen 15 is moved downward to apply pressure against the wafers W. The carrier 11 enables efficient processing in that wafers W can be polished under relatively high pressure, e.g., a pressure of about 9–10 kPa, and in that the wafers are polished down to about the same thickness as the insert 41 (see FIG. 3) or slightly less than the thickness of the insert. As noted above, it may be desirable to polish the wafers W to a thickness slightly less than that of the insert so that the wafer is slightly "dished", i.e., each wafer is slightly thicker at or adjacent its edge WE. Note that such polishing may cause the insert 41 to also be polished slightly, but advantageously, such polishing will not cause polishing of the plate 25 or removal of metal ions or impurities from the plate 25. The carrier 11 also enables the production of wafers W having very good flatness, e.g., an $SFQR_{max}$ less than 0.07 microns on a 25×25 mm site and a TTV of from about 0.1 to about 0.5 microns, more preferably about 0.1 to 0.2 microns. The difference in thickness between the insert 41 and the plate 25 substantially ensures that the plate will "hydroplane", i.e., it will be substantially supported by the slurry and not by the pads. The difference in thickness also ensures that substantially no contaminant material will be removed by polishing the plate and enter the polishing slurry or pads. Accordingly, contamination of the wafers W is significantly reduced. In testing, the carrier 11 reduced bulk metal contamination by more than an order of magnitude, from $2\times10^{13}$ (conventional carrier) to about $5\times10^{11}$ atoms/cm$^2$.

Figure 6:
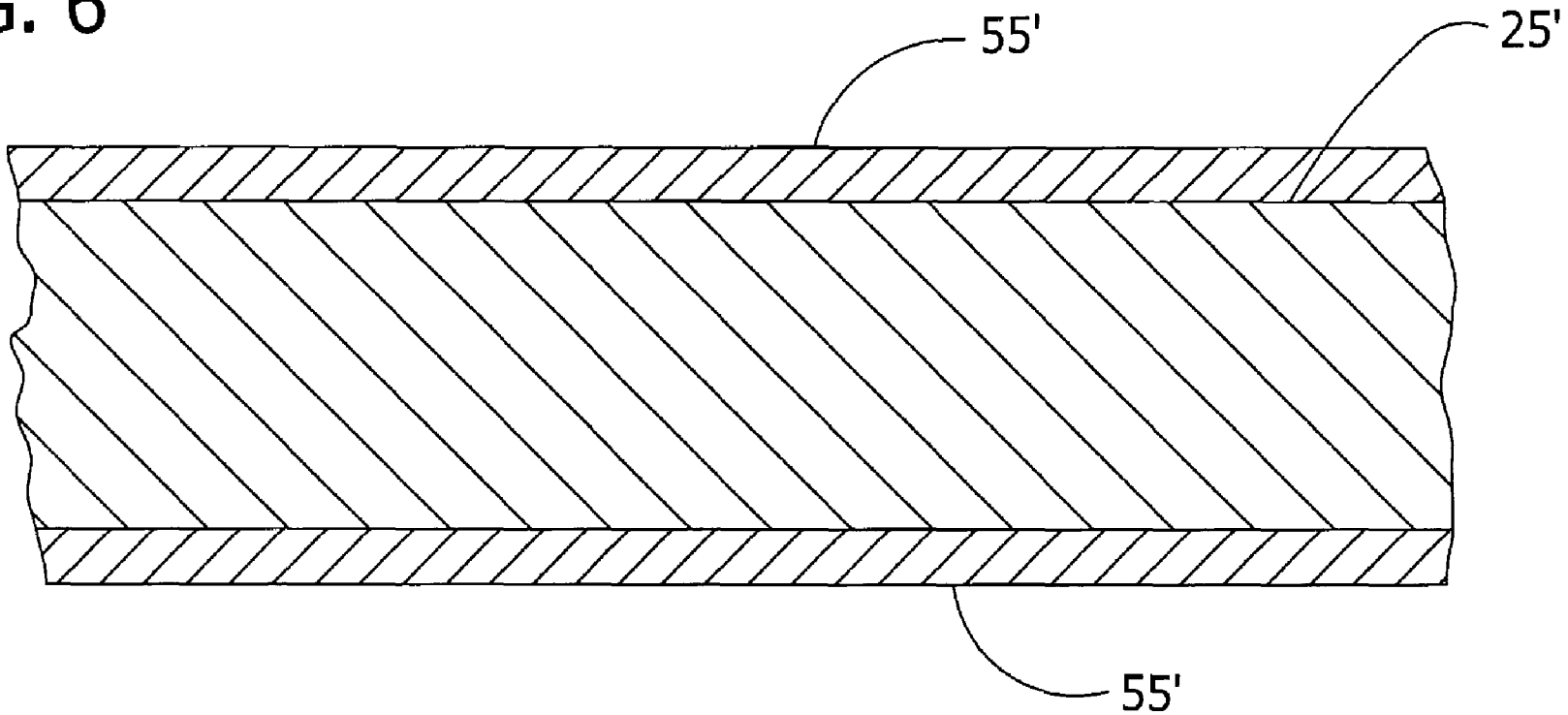
FIG. 6 is a section view of a coated plate of another embodiment of the invention.

Referring to FIG. 6, plate 25' is modified to include a non-metallic coating 55' to reduce or eliminate exposed metal surfaces on the carrier. The thickness of the coated plate 25' falls within the ranges described above. Accordingly, the coating will not be polished and is, therefore, unlikely to delaminate from the metallic portion of the plate. The coating is suitably made of plastic, preferably of the same type as the insert 41. Such a coating may be desirable to reduce leaching of metal ions caused by the polishing fluids.

As various changes could be made in the above constructions without departing from the scope of the invention, it is intended that all matter contained in the above description or shown in the accompanying drawings shall be interpreted as illustrative and not in a limiting sense. For example, the carrier 11 may hold any number of wafers, including only one. The carrier may include several inserts within the metal plate, each insert adapted for holding just one wafer (as shown in U.S. Pat. No. 6,454,635, which is incorporated herein by reference). However, where the insert is removable from the plate, it is preferred that the insert be of sufficient mass and density to be non-buoyant. For example, the insert 41 is adapted to hold three wafers because such an insert has sufficient mass to be non-buoyant and thereby inhibit the insert from floating out of engagement with the plate. Other means of securing the insert 41 within the plate 25 so as to prevent movement of the insert relative to the plate during polishing may be used within the scope of this invention. The insert 41 may also be permanently bonded to the plate 25, e.g., molded into the plate, within the scope of this invention.

Additionally, a plate (not shown) of the invention may be constructed to reduce, rather than eliminate areas of the plate that may be subjected to polishing. For example, the plate may have a non-uniform thickness, e.g., portions of the plate may be chemically etched or machined away to inhibit substantial portions of the plate from being polished. In such case, remaining thicker portions of the plate 25 may still be close enough to the pads 19, 21 for material to be polished therefrom, but the reduction in surface area of the plate subject to polishing is beneficial for reducing contamination of the wafer.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

What is claimed is:

1. A wafer carrier for retaining at least one semiconductor wafer in a processing apparatus during a processing operation which removes wafer material by at least one of abrading and chemical reaction, said processing apparatus adapted for removing wafer material from a front side and a back side of each wafer simultaneously, the carrier comprising:

a plate including wafer contaminating material and having an opening and a thickness; and an insert having a thickness and being disposed in the opening of the plate for receiving at least one wafer and engaging a peripheral edge of the wafer to hold the wafer as the carrier rotates, the thickness of the insert being at least about 20 microns greater than the thickness of the plate to inhibit removal of the contaminating material from the plate during processing and thereby inhibit contamination of the wafer.

2. A wafer carrier as set forth in claim 1 wherein said insert is at least about 30 microns thicker than the plate.

3. A wafer carrier as set forth in claim 1 wherein said insert is at least about 50 microns thicker than the plate.

4. A wafer carrier as set forth in claim 1 wherein at least a portion of the plate is constructed of metal and wherein the insert is substantially free of metal.

5. A wafer carrier as set forth in claim 1 wherein the plate is coated to reduce a surface area of exposed metal.

6. A wafer carrier as set forth in claim 1 wherein the insert is removable from the plate and is not buoyant to inhibit the insert from separating from the plate during loading and unloading of wafers.

7. A wafer carrier as set forth in claim 6 wherein the insert is of one-piece construction.

8. A water carrier as set forth in claim 7 wherein the carrier has a center and wherein the insert is formed so that the at least one wafer is offset from the center.

9. A wafer carrier as set forth in claim 8 wherein the plate is generally ring-shaped and has gear teeth around its periphery.

10. A wafer carrier as set forth in claim 6 wherein the insert and plate have interengageable teeth for inhibiting movement of the insert relative to the plate during processing and f or allowing easy placement of the insert within the plate.

11. A water carrier as set forth in claim 12 wherein a pressure angle of each tooth is at least about 10° to distribute stress on the teeth and to allow for easy placement of the insert within the plate.

12. A wafer carrier as set forth in claim 10 wherein the teeth are sized and shaped to distribute stress on the teeth.

13. A wafer carrier for retaining at least two semiconductor wafers in a processing apparatus during a processing operation which removes water material by at least one of abrading and chemical reaction, said processing apparatus adapted for removing wafer material from a front side and a back side of each water simultaneously using a polishing fluid, the carrier comprising:

a plate including wafer contaminating material and having an opening; and an insert removably disposed in the opening of the plate, the insert having holes for receiving said at least two wafers and engaging a peripheral edge of each water to hold each wafer as the carrier rotates, and the insert having negative buoyancy in the polishing fluid to inhibit the insert from separating from the plate during loading and unloading of wafers.

14. A wafer carrier as set forth in claim 13 wherein the carrier has a center, and wherein respective centers of the holes in the insert are offset from the center of the carrier.

15. A wafer carrier as set forth in claim 13 wherein said wafer contaminating material is metal and wherein the insert is substantially free of metal.

16. A wafer carrier as set forth in claim 15 wherein a thickness of the insert is at least about 20 microns greater than a thickness of the plate to inhibit removal of contaminating material from the plate during processing and thereby inhibit bulk metal contamination of the wafer.

17. A wafer carrier as set forth in claim 13 wherein the insert is of one-piece construction.

18. A wafer carrier as set forth in claim 17 wherein the plate is annular.

19. A wafer carrier as set forth in claim 18 wherein the insert and plate have engageable teeth for inhibiting movement of the insert relative to the plate during processing and for allowing easy placement of the insert within the plate.

20. A double-side polishing apparatus for polishing a front side and a back side of semiconductor wafers simultaneously, the apparatus comprising:

a rotatable upper platen mounting an upper polishing pad and a rotatable lower platen mounting a lower polishing pad;

a wafer carrier for retaining a set of the semiconductor wafers in between the upper and lower pads, the carrier including:

a) a plate made at least partially of metal and having an opening; and b) an insert having a thickness and being disposed in the opening for receiving the set of wafers, the thickness of the insert being at least 20 microns greater than the thickness of the plate to inhibit removal of material from the plate and thereby inhibit bulk metal contamination of the wafer.

21. The double-side polishing apparatus as set forth in claim 20 wherein said insect is at least about 30 microns thicker than the plate.

22. The double-side polishing apparatus as set forth in claim 21 wherein a gap between the plate and at least one of the upper and lower polishing pads is at least about 20 microns during polishing.

23. The double-side polishing apparatus as set forth in claim 20 wherein the opening in the plate is disposed entirely within the outer peripheries of the upper and lower polishing pads.

24. The double-side polishing apparatus as set forth in claim 20 wherein the carrier has a center, and wherein respective centers of the wafers in the insert are offset from the center of the carrier.

25. The double-side polishing apparatus as set forth in claim 24 wherein the lower polishing pad has a fluid thereon, and wherein the insert is removable from the plate and is not buoyant in the fluid to inhibit the insert from separating from the plate during loading and unloading of wafers from the apparatus.

* * * * *

UNITED STATES PATENT AND TRADEMARK OFFICE

CERTIFICATE OF CORRECTION

PATENT NO. : 7,008,308 B2
APPLICATION NO. : 10/442900
DATED : March 7, 2006
INVENTOR(S) : Mick Bjelopavlic et al.

It is certified that error appears in the above-identified patent and that said Letters Patent is hereby corrected as shown below:

Column 6
Claim 10, line 60, “and f or” should read -- and for --.

Column 8
Claim 21, line 16, “said insect is” should read -- said insert is --.

Signed and Sealed this

Twenty-eighth Day of August, 2007

JON W. DUDAS
*Director of the United States Patent and Trademark Office*